United States Patent [19]

Wells

[11] 4,085,779

[45] Apr. 25, 1978

[54] PACKAGING MACHINE

[75] Inventor: Roy E. Wells, Maquoketa, Iowa

[73] Assignee: The Kartridg Pak Company, Davenport, Iowa

[21] Appl. No.: 785,119

[22] Filed: Apr. 6, 1977

[51] Int. Cl.[2] ..... B65B 13/28; B65B 51/04; B26D 5/08; B26D 5/18

[52] U.S. Cl. ..... 140/93 A; 53/138 A; 53/198 A; 83/245; 83/530; 83/580; 83/630

[58] Field of Search ..... 53/138 A, 198 A; 83/244, 245, 530, 560, 580, 630; 140/93 A, 93.2, 93.6, 140

[56] References Cited

U.S. PATENT DOCUMENTS

| | | | |
|---|---|---|---|
| 1,650,841 | 11/1927 | Lewis | 83/560 |
| 2,494,413 | 1/1950 | Slettengren | 83/630 X |
| 3,426,635 | 2/1969 | Nicklasson | 83/630 X |
| 3,664,220 | 5/1972 | Blair | 83/245 X |
| 3,795,083 | 3/1974 | Wells | 53/138 A |
| 3,983,772 | 10/1976 | Oldham | 83/245 X |

FOREIGN PATENT DOCUMENTS

| | | | |
|---|---|---|---|
| 24,412 | 10/1909 | United Kingdom | 83/244 |

*Primary Examiner*—E. M. Combs

*Attorney, Agent, or Firm*—Lockwood, Dewey, Zickert & Alex

[57] ABSTRACT

A packaging machine is provided in which wire is fed for cutting into predetermined lengths for subsequent formation into U-shaped clips for clinching about a constricted product filled tube. It includes means for varying the length of the cut off portion by adjusting the position of a wire receiving member or cut off round and a cut off knife along the wire. Also the wire is fed intermittently to be cut off through an extent corresponding to the length to be cut off. The cut off length is variably formed according to the desired length of the U-shaped clip with the legs thereof in various angular relations.

10 Claims, 12 Drawing Figures

FIG. 4
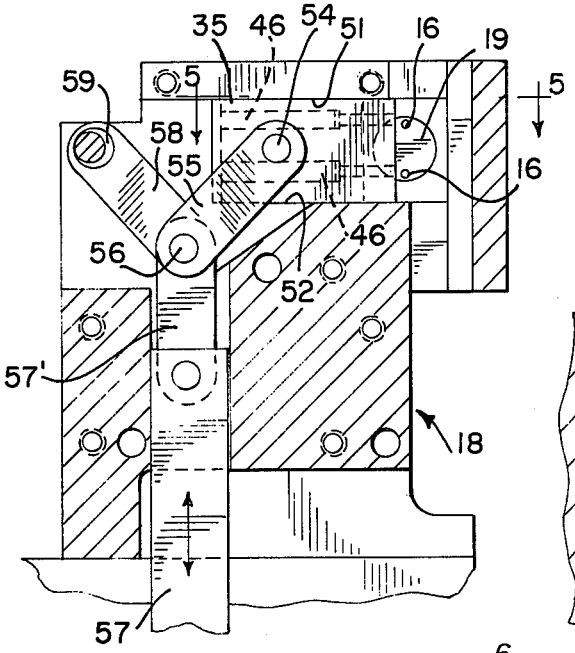
FIG. 6
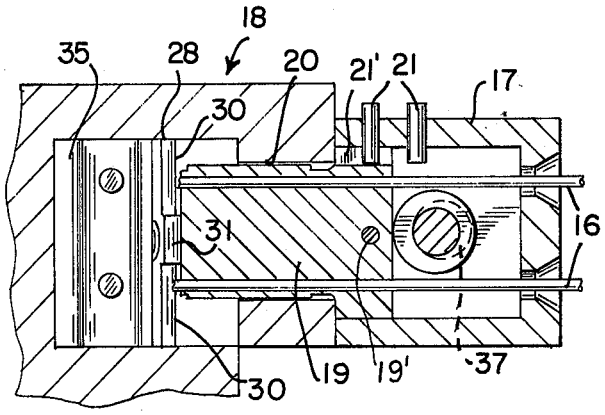
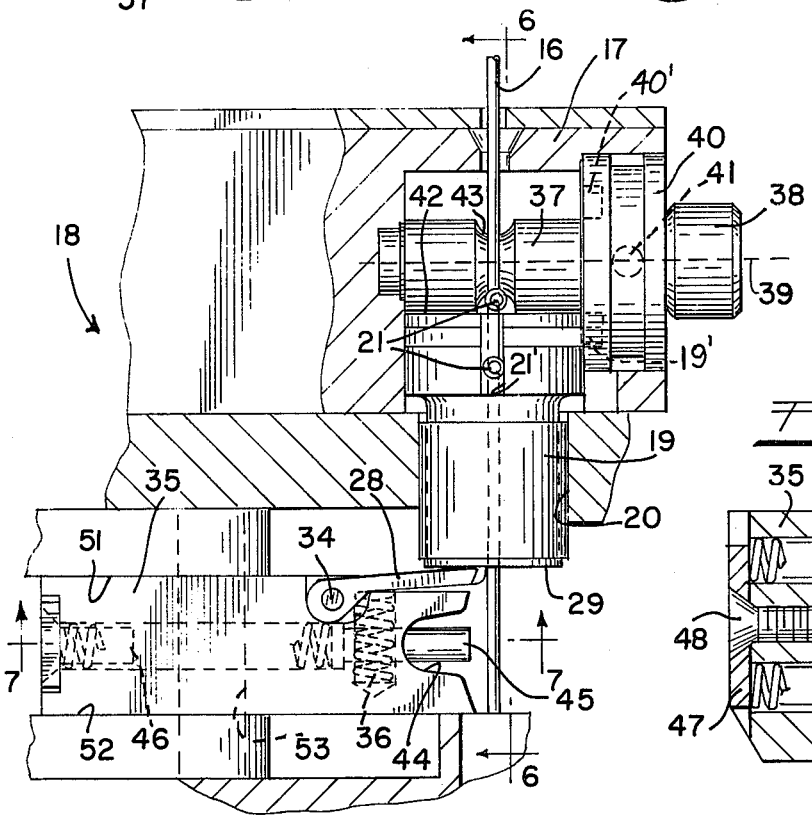
FIG. 7
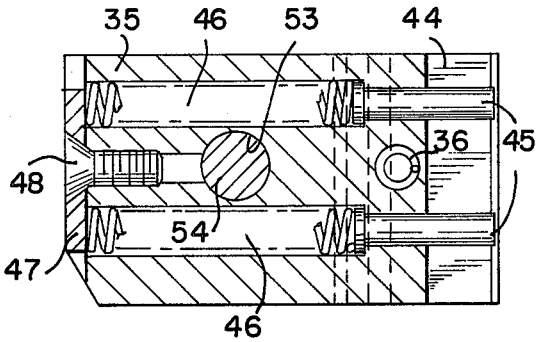
FIG. 5

FIG. 8
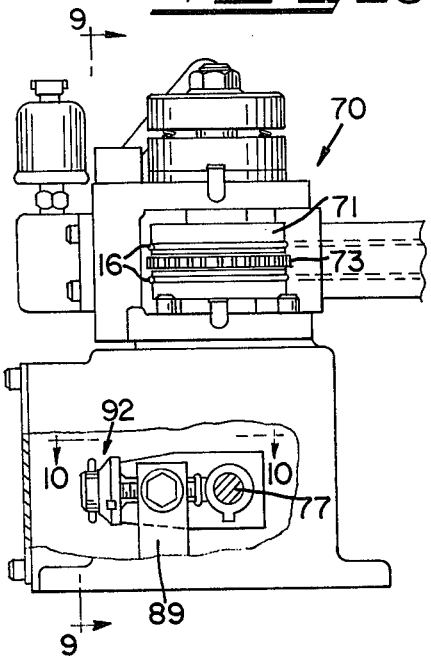
FIG. 9
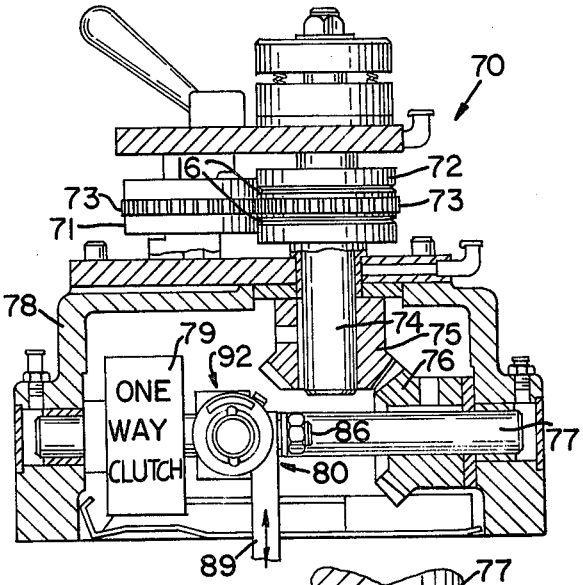
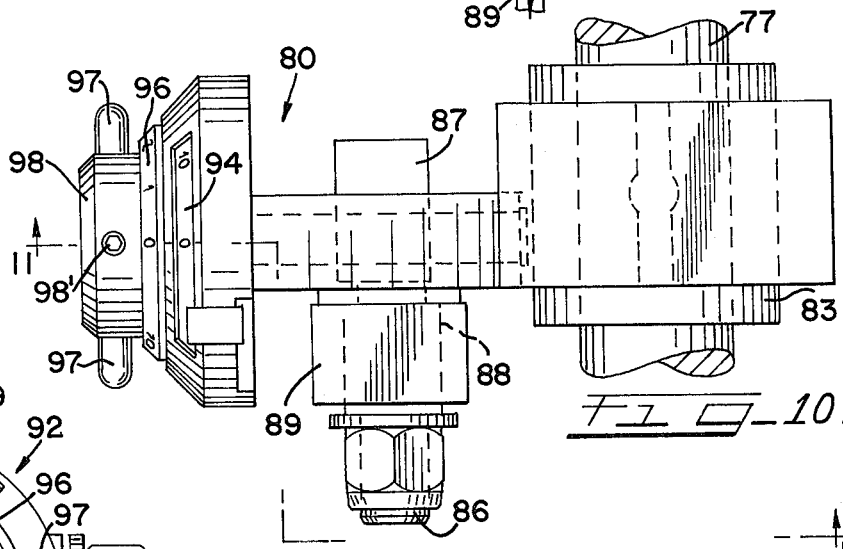
FIG. 10
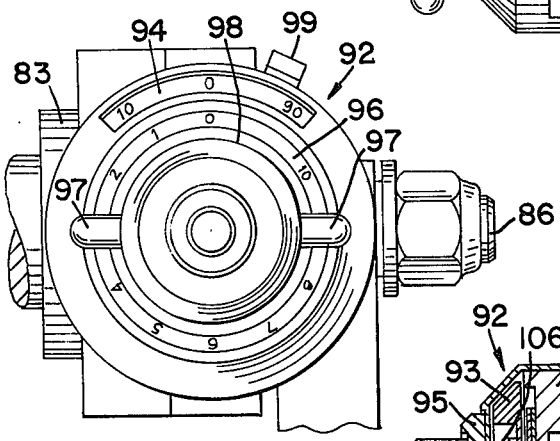
FIG. 11
FIG. 12
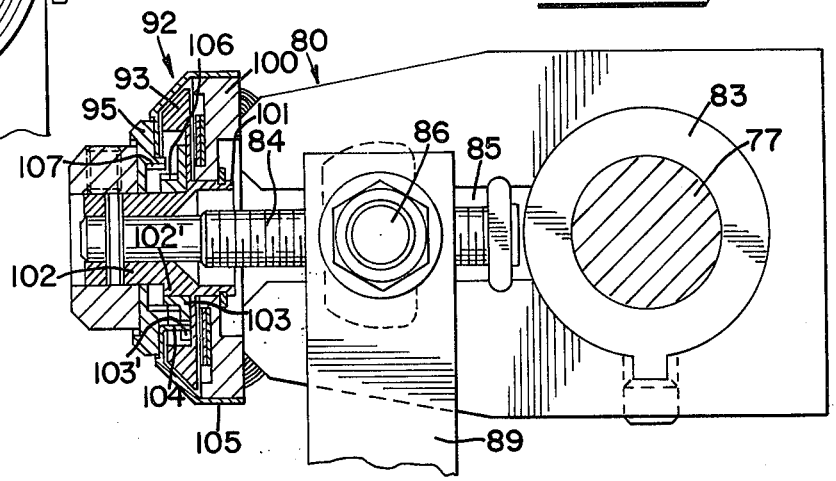

PACKAGING MACHINE

This invention relates, generally, to packaging machines, known in the art as Chub machines, and constitutes an improvement over the packaging machines disclosed in U.S. Pat. Nos. 2,831,302, issued Apr. 22, 1958, and 3,380,226, issued Apr. 30, 1968, and copending application, Ser. No. 784,730, filed Apr. 5, 1977 by Donald R. Wright and assigned to the assignee of the present application.

In prior art Chub machines, in order to obtain a wire length suitable to function well as a tight wrap-around or butt type wire clip, it was necessary to purchase a large number of precision made forming plates or blocks very close in size to each other. This was expensive. Also, the services of a skilled mechanic were required to install the proper cut-off punch assembly and adjust the wire feed so as to change the clip length to accommodate different packaging operations. Heretofore the clip legs were adjusted in finite steps as determined by the dimensions of the precision made forming plates or cut off blocks. The width of the cut off block determined the length of the inner clip leg while the length of the wire feed determined the length of the outer leg. The adjustment of the wire feed length was uncalibrated and required a cut-and-try method to achieve balanced leg lengths when changing clip sizes. This also required the services of a skilled mechanic.

Among the objects of this invention are: To provide in a Chub machine means within the skill of an ordinary operator for adjusting it for making and using clips of different lengths; and, within limited ranges, to provide for infinitely varying the length of the inner clip leg, the length of the outer clip leg, and the angles at which the arms of clips of different lengths are formed in order to crimp them properly around a constricted product filled tube.

In the drawings:

FIG. 4 is a vertical sectional view taken generally along line 4—4 of FIG. 3.

FIG. 5 is a horizontal sectional view taken generally along line 5—5 of FIG. 4.

FIG. 6 is a vertical sectional view taken generally along line 6—6 of FIG. 5.

FIG. 7 is a vertical sectional view taken along line 7—7 of FIG. 5.

FIG. 8 is a side elevational view of the wire feed unit taken generally along line 8—8 of FIG. 1.

FIG. 9 is a vertical sectional view taken generally along 9—9 of FIG. 8.

FIG. 10 is a top plan view, at an enlarged scale, taken generally along line 10—10 of FIG. 8 and shows certain details of construction of the clutch crank arm.

FIG. 11 is a horizontal sectional view taken generally along line 11—11 of FIG. 10.

FIG. 12 is an end view, looking from left to right, of FIG. 10.

Figure 1:
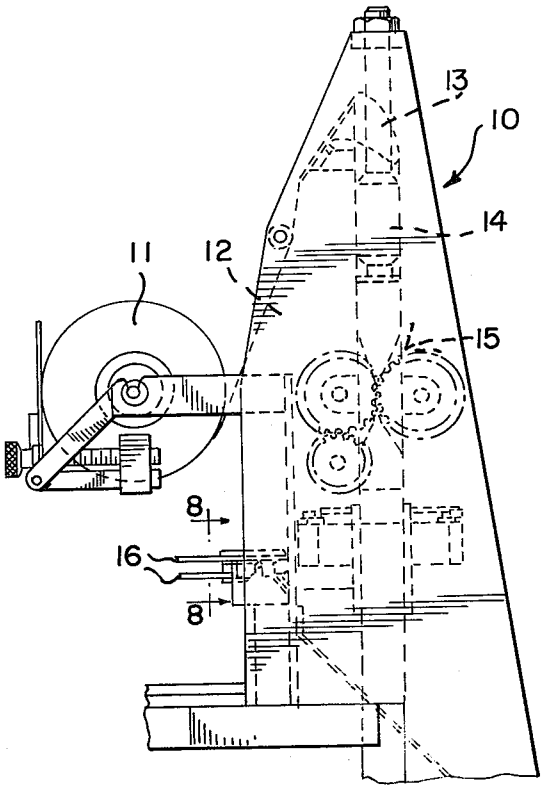
FIG. 1 is a partial side elevational view of a packaging machine in which this invention is embodied. It corresponds, generally, to FIG. 1 of each of the above patents.

In referring now, particularly to FIG. 1, it will be observed that the reference character 10 designates, generally, a Chub packaging machine of the kind and the type disclosed in the above patents. It includes a reel 11 from which a web of film 12 is drawn over a tube forming die 13 and then over a stuffing mandrel 14. It is then suitably longitudinally sealed as described in the above patents. Tube drawing mechanism 15 acts to continuously draw the stuffed tube downwardly. As illustrated in FIG. 10 of U.S. Pat. No. 3,380,226, the stuffed tube is gathered intermediate its ends and is sealed off by means of metal clips as described more fully hereinafter.

Referring now particularly to FIGS. 2–7 of the drawings, it will be observed that two wires 16 (FIG. 6) are withdrawn from suitable spools, not shown, and are threaded through a block 17 that is suitably mounted on a frame that is indicated, generally, at 18. It will be understood that the frame 18 is suitably mounted on the machine 10 so that the wires 16 can be threaded directly therethrough.

Mounted within the frame 18 is a wire receiving member or "cut off round" 19. It will be noted that the two wires 16 are received by the member 19 near its periphery and at upper and lower diametrically opposite positions. The member 19 is slidable in a cylindrical opening 20 that is formed in the frame 18. Guide pins 21, extending through the upper side of the block 17 and into a slot 21', serve to maintain the member 19 in proper axially aligned position.

Figure 3:
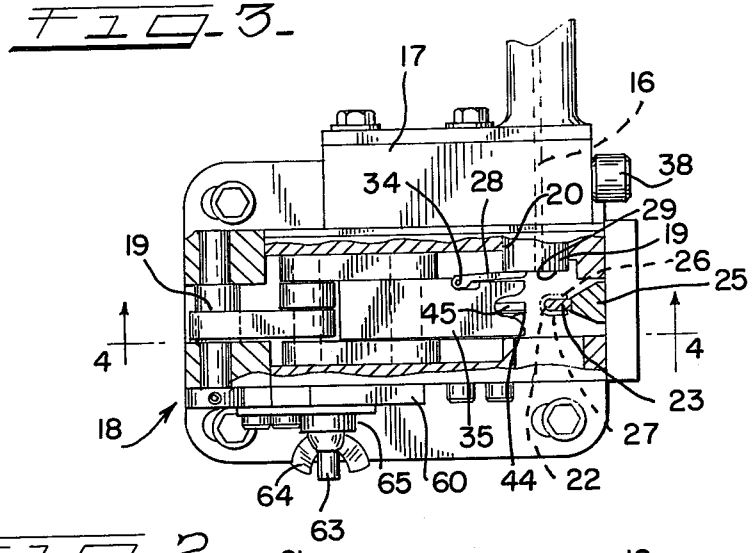
FIG. 3 is a horizontal sectional view taken generally along the line 3—3 of FIG. 2.

It will be understood that the two wires 16 are fed simultaneously through the wire receiving member 19 for the ultimate purpose of forming U-shaped wire clips, one of which is shown at 22 in FIG. 3. The wire clips are of a generally U-shape and are formed about a nose 23 of an anvil that is carried by a vertically reciprocable rod 25. Each wire clip has an inner leg 26 and an outer leg 27 that preferably are of identical lengths for proper crimping operation about the gathered tube so as to form a complete seal therearound.

The proper length of each of the wires 16 is simultaneously cut by means of a knife blade 28 which bears against the flat surface 29 of the wire receiving member 19 as shown more clearly in FIG. 5. The knife blade 28 has two cutting edges 30 (FIG. 6) with a wear projection 31 therebetween.

As shown in FIG. 5, the knife blade 28 is pivoted at 34 on a cut off block or forming plate 35. A coil compression spring 36 reacts between the cut off block or forming plate 35 and the knife blade 28 to bias it against the flat surface 29 of the member 19. Not only does the coil compression spring 36 bias the knife blade 28 against the flat surface 29 of the wire receiving member 19 but also it biases the latter outwardly against an eccentric 37 which is mounted in the block 17. An adjusting knob 38 is connected to the eccentric 37 for positioning it. It is rotatable about an axis indicated by broken line 39.

By means of the cooperation between the coil compression spring 36 and the eccentric 37, the position of the wire receiving member or cut off round 19 can be accurately adjusted for the purpose of varying the length of the wires 16 that are cut off for forming each of the wire clips 22. Rotatable with the eccentric 37 and knob 38 is a disc 40 which carries a suitable scale, not shown, that indicates the length of the wires 16 that is being cut off for each particular setting of the eccentric 37. A set screw 41 is arranged to cooperate with the eccentric 37 for holding it in any position to which it may be adjusted by the knob 38. It will be understood that the eccentric 37 reacts against an end surface 42 of the wire receiving member 19 for moving it against a biasing action of the coil compression spring 36. In addition, receiving member 19 is prevented from undesirably overcoming the biasing action of compression spring 36 due to excessive wire friction or kinks by pin 19' captured in recess 40' which is concentric to eccentric 37.

The eccentric 37 is circumferentially grooved as indicated at 43 to accommodate the two wires 16 which extend through the block 17 and into the wire receiving member 19.

As shown in FIGS. 3, 5 and 7, the end of the cut off block or forming plate 35 adjacent the portion of the wires 16 that has been fed through the member 19 is provided with a groove 44 that is arranged to cooperate with the nose 23 of the anvil for forming the U-shaped wire clips 22 thereover. Ejector pins 45, biased outwardly by coil compression springs 46, act to eject the formed clips 22 from the groove 44 after they have been formed around the nose of the anvil 23. The ejected clips remain on the anvil. As shown in FIG. 7, the coil compression springs 46 are held captive in the cut off block or forming plate 35 by means of a plate 47 that is secured in place by a screw 48.

As shown in FIG. 4, the cut off block or forming plate 35 is slidably mounted between upper and lower surfaces 51 and 52 in the frame 18, and an aperture 53 extends through the cut off block or forming plate 35 for receiving a pin 54 that is connected by a link 55 to a pin 56 that extends through a link 57' which is connected at its lower end to the upper end of a vertically reciprocable member 57. A link 58 interconnects the pin 56 and an eccentric pin 59 that is journaled in the frame 18. The reason for the eccentric pin 59 is to vary the stroke or throw of the cut off block or forming plate 35. In some instances, it is desirable to have the legs 26 and 27 diverge slightly from the parallel relation, particularly when relatively long clips are formed, in order to avoid damage to the packaging material caused by projection of clip legs into the path of the packaging material as it passes through the clip-applying mechanism described in the above patents.

Figure 2:
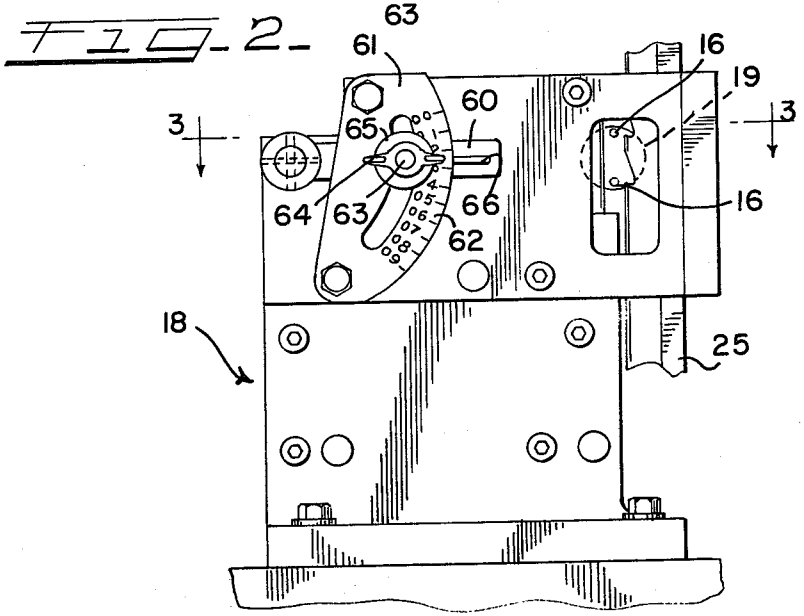
FIG. 2 is a view, in side elevation, of the wire cut-off unit which houses the mechanism for adjusting the stroke of the forming plate or cut off block to accommodate different lengths of clips.

For adjusting the eccentric 59, an arm 60, FIGS. 2 and 3, is connected to it and it extends between the side of the housing 18 and a sector plate 61 suitably mounted in spaced relationship on the frame or housing 18. The plate 61 has a scale 62 with respect to which the arm 60 can be adjusted. A threaded stud 63 extends from the arm 60 and a wing nut 64 threaded thereon reacts against a collar 65 to hold the arm 60 in any predetermined adjusted position. Preferably the collar 65 carries a pin on its inner face with projects into holes on the scale 62 to lock the arm in any adjusted position. An index groove 66 in the arm 60 cooperates with the scale 62 for properly locating the arm 60.

It will be understood that the two wires 16 are fed simultaneously in step by step fashion, as will be described hereinafter, through the wire receiving member or cut off round 19 to the position shown in FIG. 5. Thereafter, the vertically reciprocable member 57 is operated by the machine 10 in proper timed relationship to move the knife blade 28 forwardly for simultaneously cutting off two lengths of the wire 16. Continued forward movement of the cut off block or forming plate 35 causes the cut off lengths of the wires 16 to be formed into the desired U-shape clips 22 about the nose 23 of the anvil. Thereafter the cut off block or forming plate 35 is withdrawn by a continued reciprocable movement of the member 57 as will be understood readily. The clips 22 remain on the nose portion of the anvil 23 and then they are withdrawn by a clip-applying mechanism described in the above patents. Subsequently the anvil 23 is moved downwardly by the vertically reciprocable rod 25 in proper timed relationship to clear the mechanism which is employed for gathering the stuffed tube, for crimping the clips 22 about the gathered portion and subsequently for severing the gathered portion between the two clips that have just been crimped in sealing position.

Referring now particularly to FIGS. 8–12, the variable intermittently feeding mechanism for the wires 16 now will be described. The wire feed mechanism is shown, generally, at 70. It includes a pair of wire feed rollers 71 and 72 which have meshing gear sections 73. The roller 72 is mounted on a shaft 74 which carries a bevel gear 75 that meshes with a bevel gear 76 secured for rotation to a shaft 77 that is journaled at its ends in a housing 78. Mounted on the shaft 77 is a one-way clutch 79 of known type that is arranged to interconnect the shaft 77 with a clutch arm that is indicated, generally, at 80, FIGS. 10 and 11. The clutch arm 80 is secured to a sleeve 83 that is journaled on the shaft 77.

The throw or extent of forward movement of the wires 16 can be varied by means of a screw 84 that is located in a slot 85 which is formed in the clutch arm 80. The threaded member 84 passes through a threaded aperture in a transverse pin 86 which has a head 87 at one end and a section which guides it in slot 85. The pin 86 carries a spool bearing 88 on which is journaled the upper end of 89 of a reciprocating member. By varying the position of the pin 86 in the slot 85 by rotating the threaded member 84, it is possible to change the distance between the center of the pin 86 and the axis of rotation of the shaft 77.

Secured to the threaded member 84 is calibrating means, indicated generally at 92, which includes a calibrated dial 93 carrying a vernier scale 94. For illustrative purposes, it is pointed out that the scale 94 extends from 0 through 90 back to 0 so that one turn of the screw or threaded member 84 corresponds to one complete revolution of the dial 93 which is divided into 100 divisions. An auxiliary dial 95 is driven through the calibrated dial 93. It carries a scale 96 which indicates the number of turns that have been made by the threaded member 84. Operating pins 97 extend from a ring 98 that is secured to the threaded member 84 by set screw 98' to facilitate manual rotation thereof. A support ring 100 is welded onto the end of the arm 80 with its inner portion journaling the enlarged inner end 101 of a sleeve member 102 pinned to the screw 84. A hubbed disc 103 is carried on an eccentric hub 102' of sleeve 102 and prevented from rotating with sleeve 102 by tab 104 on cover 105 locking in slot 103'. Dial 93 is an enlarged outer portion of sleeve 102. With this arrangement, the dial 93 turns directly with the rotation of the screw 84. The hub on the disc 103 has external gear teeth 106 which mesh progressively with internal gear teeth 107 on the interior of the auxiliary dial 95 in response to the eccentric motion of hub 102'. One complete rotation of the screw 84 and the dial 93 advances the dial 95 one scale mark. Suitable clutch means are provided for locking the dial 93 and thereby the screw 84 in any adjusted position. A brake arm 99 extends from this mechanism for securing the threaded member 84 in adjusted position if desired.

By providing for varying the extent to which the wire feed rollers 71 and 72 are intermittently advanced, it is possible to compensate for the increased or decreased lengths of the wires 16 as adjusted by the position of the wire receiving member or cut off round 19 so that the lengths of the inner and outer legs 26 and 27 of the clips 22 can be properly equalized.

I claim:

1. In a machine in which wire is fed by wire feeding means and cut into pieces of predetermined lengths which are formed into U-shaped clips and clinched about a constricted product-filled tube, said machine having a wire cut off and clip forming unit including frame means providing a channel in which a combination cut off block and clip forming plate is reciprocable, means for varying the lengths of said pieces of wire, comprising: a wire receiving member slidably mounted on said frame means on an axis extending perpendicular to the direction of reciprocation of said wire cut off block and clip forming plate; positioning means carried by said frame means and operably connected with said wire receiving member for adjusting the extent to which member protrudes into said channel towards one side of said cut off block and forming plate, the protruding portion of said member having a wire cut off end surface through which wire emerges from said member into said channel; a wire cutting blade having a shearing edge pivotally mounted on said one side of said cut off block and forming plate; and spring means acting between said blade and said cut off block and forming plate to maintain the shearing edge of said blade in engagement with said wire cut off end surface during reciprocation of said cut-off block-forming plate.

2. In a machine according to claim 1 wherein said wire receiving member is cylindrical in form and said wire is fed endwise therethrough near the periphery thereof.

3. In a machine according to claim 1 wherein eccentric means mounted in said frame cooperate with said wire receiving member to shift the same toward said knife blade.

4. In a machine according to claim 1 wherein said spring means serves to bias said wire receiving member against said eccentric means.

5. In a machine according to claim 1 wherein means are provided to adjust the throw or stroke of said cut off block and clip forming plate.

6. In a machine according to claim 5 wherein a reciprocating actuating member is operatively connected to said cut off block and clip forming plate by a pair of links jointly pivoted at one end to said reciprocating member with one link pivoted to said cut off block and clip forming plate and the other link pivoted through an adjustable eccentric pivot to said frame means.

7. In a machine according to claim 1 wherein said wire feeding means intermittently moves said wire through said wire receiving member, and means vary the throw or stroke of said wire feeding means according to the length of said wire that is to be cut off.

8. In a machine according to claim 7 wherein said wire feeding means includes a reciprocating actuating member, a clutch crank arm is connected to said reciprocating member, a one-way clutch interconnects said clutch crank arm to said feeding means, and said means to vary said throw of said feeding means includes means for changing the position of the connection between said reciprocating actuating member and said clutch crank arm.

9. In a machine according to claim 8 wherein said connection between said reciprocating actuating member and said clutch arm includes a threaded member, a pin on said threaded member connected to said reciprocating actuating member, a calibrated dial connected to said threaded member to indicate the extent of each rotation thereof, and an auxiliary dial driven by said calibrated dial to indicate the number of rotations of said threaded member.

10. In a machine according to claim 6 wherein a manually positionable arm is mounted on said adjustable eccentric and extends transversely of a sector-like plate having graduations thereon and an arcuate slot therein mounted on said frame or housing, a screw projects from said arm through said arcuate slot, a collar is freely carried on said screw and has a pin extending therefrom which is receivable in holes in said sector-like plate associated with said graduations, and a nut is threaded onto said screw so as to releasably tighten together in adjusted positions of said arm said sector-like plate, said collar and said arm.

* * * * *